US005452891A

United States Patent [19]

Thomas

[11] Patent Number: 5,452,891

[45] Date of Patent: Sep. 26, 1995

[54] GOLF PUTTER IMPROVEMENTS AND CONVERTER METHODS

[76] Inventor: Robert K. Thomas, 69 Rockland St., Malone, N.Y. 12953

[21] Appl. No.: 242,445

[22] Filed: May 13, 1994

[51] Int. Cl.[6] ..... A63B 53/16

[52] U.S. Cl. ..... 273/81.2; 273/81 D; 273/80 D; 273/194 R

[58] Field of Search ..... 273/80 D, 80 R, 273/81 R, 165, 81.2, 191 R, 188 R, 163 A, 194 R, 193 R, 193 A, 186.2, 187.2, 192, 81 D

[56] References Cited

U.S. PATENT DOCUMENTS

| | | | |
|---|---|---|---|
| 1,569,765 | 1/1926 | Lowell | 273/81.2 |
| 1,613,360 | 1/1927 | Rigby | 273/80 D |
| 1,648,806 | 11/1927 | Hadden | 273/81.2 |
| 2,027,452 | 1/1936 | Rusing | 273/80 D |
| 2,107,983 | 2/1938 | Hamilton | 273/80 D |
| 2,214,079 | 9/1940 | Horton | 273/80 D |
| 2,475,927 | 7/1949 | Verderber | 273/81.2 |
| 3,188,086 | 6/1965 | Parmley | 273/80 D |
| 3,539,185 | 11/1970 | Andis | 273/80 D |
| 3,897,058 | 7/1975 | Koch | 273/81 R |
| 5,029,860 | 7/1991 | Ehrich | 273/80 D |
| 5,156,401 | 10/1992 | Hodgkiss | 273/186.2 |

*Primary Examiner*—Sebastiano Passaniti

*Attorney, Agent, or Firm*—Raymond N. Baker; Shanley and Baker

[57] ABSTRACT

Golf putting structures and methods for dual-length conversion of a putter-club, including height adjustment to facilitate a pendulum-like putting stroke so as to minimize the opportunity for outside interferences. Adjustable length and rapid conversion features provide the option of using a first preselected putter length while enabling ready conversion, without attracting undue attention, to an extended length. In one embodiment, a hollow tapered-shaft putter is readily converted for receiving a coupling means of preselected configuration conforming to that of the hollow shaft which is integral with an externally-threaded adjustor rod. The remaining distal end of the adjustor rod is threaded into a receptor bushing which is integral with a height-augmenting receptor structure. Threading the rod into the receptor structure can be used to adjust the overall height for the combination structure.

16 Claims, 4 Drawing Sheets

GOLF PUTTER IMPROVEMENTS AND CONVERTER METHODS

INTRODUCTION

This invention relates to putter-clubs and, more particularly, is concerned with putter conversion methods and adaptor means for improving the golf-putting stroke.

Controlling movement of the putter-head during the putting stroke can be one of the most demanding parts of effective golfing. Difficulties with the putting stroke are attributed to many causes. A primary objective of the present invention is to provide means to consistently and more accurately control the line of movement during the putting stroke and the position of the putter face upon impact.

BRIEF SUMMARY OF THE INVENTION

The present invention is concerned with methods and apparatus which can be readily adapted for improving the putting stroke. Means are provided for putter conversion in which a putter structure of dual lengths is conveniently available. An extended length option takes into account the user's height and putting stance and makes that length consistently available without requiring measurement at the time of conversion.

More specific advantages and contributions of the invention are set forth as part of a more detailed description with references to the accompanying drawings, in which:

DETAILED DESCRIPTION

Controlling the putter face to move along an intended direction of movement toward, and through the lie of the ball as contact is made, is complicated by the interaction of body parts of the person swinging the club. Considering solely the upper body: the head, the shoulders and arms, each arm with an elbow and wrist, are all interacting. As long recognized, improper coaction or muscle movement of one body part can disrupt the putter's intended stroke and alignment of the putter face.

The result can be especially troublesome with short putts where a minor mishap can cause an embarrassingly wide miss; in fact, such experience has become known as having the "yips."

But, no effective way of helping the golfer in these situations has been forthcoming. The present invention discloses means and teaches methods for anchoring the upper end of a combined conversion putter structure and adaptor structure at the sternum of the golfer so as to assist in consistently achieving a desired pendulum-like movement for the putting stroke. As a result, problems with unwanted "push" or "pull" by one arm or the other, turning of the putter face, and other unexpected occurrences associated with so-called faulty body movements can be minimized or substantially eliminated.

As part of the conversion, in one specific embodiment, the invention provides an access opening at the handle end of a preselected length putter structure. Such access opening is directed longitudinally toward a hollow shaft portion near its handle end. Coupler means having a special-function configuration for mounting within the shaft is provided. A dual-length option is conveniently made available, while maintaining head and handle portions of a putter structure which are familiar to the intended user.

Figure 1:
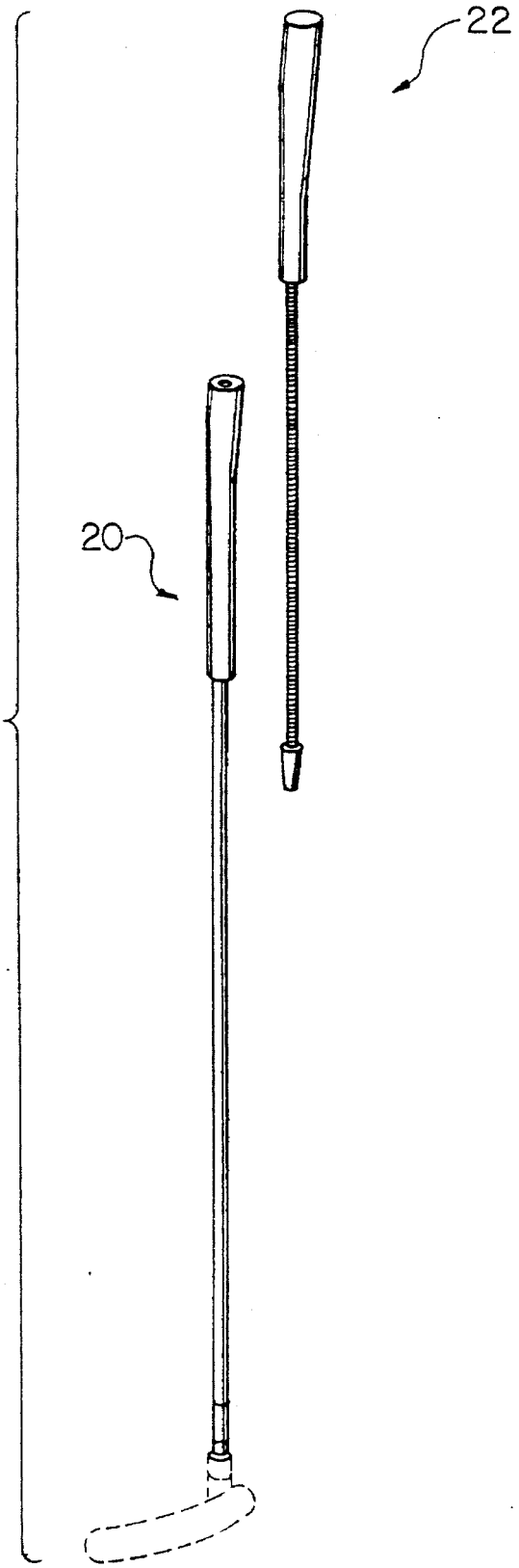
FIG. 1 is a pre-assembly perspective view for describing the combination of converted golf putter structure and adaptor structure of the present invention.
Figure 5:
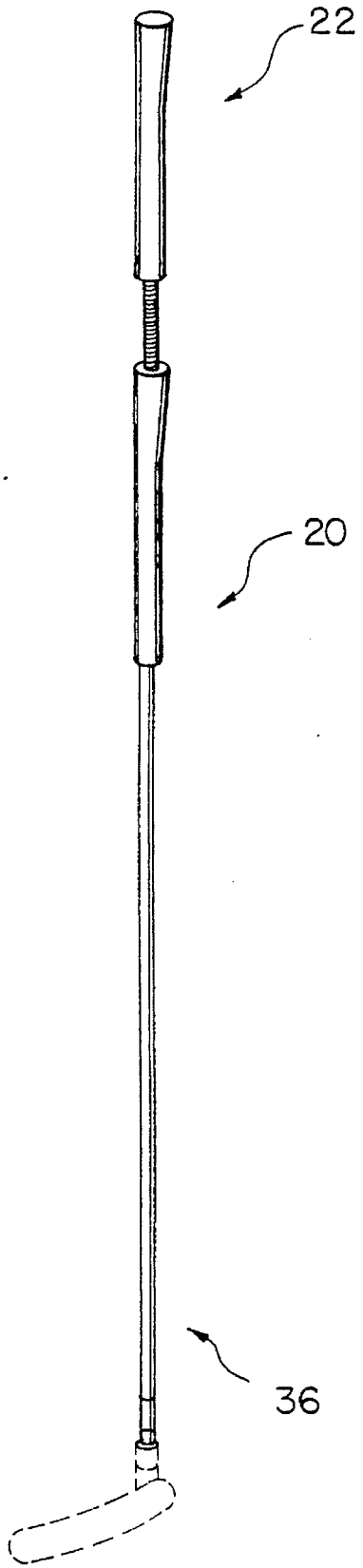
FIG. 5 is a perspective assembled view combining the structures of FIG. 1.
Figure 2:
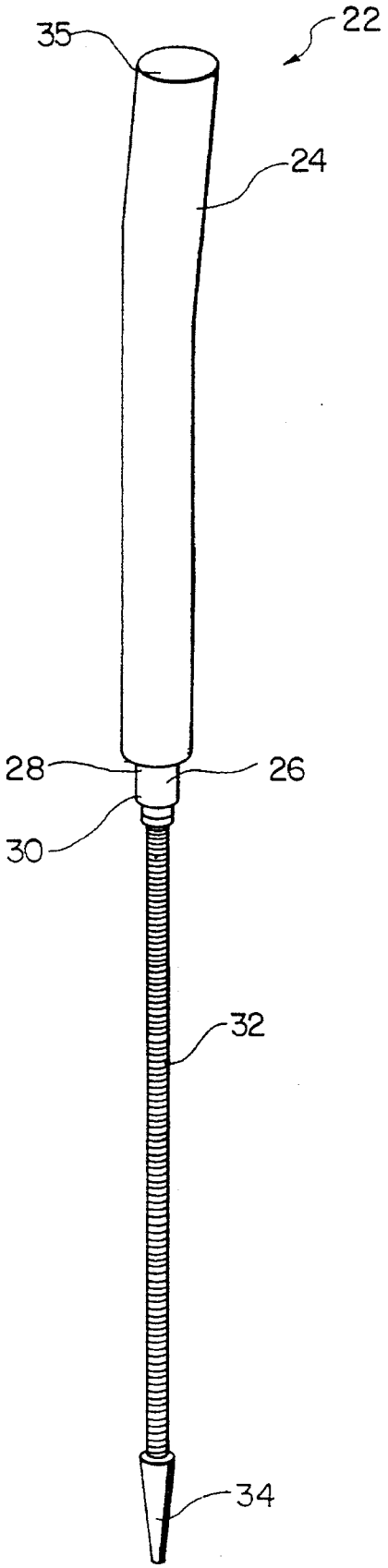
FIG. 2 is a perspective view of adaptor structure of the invention.
Figure 3:
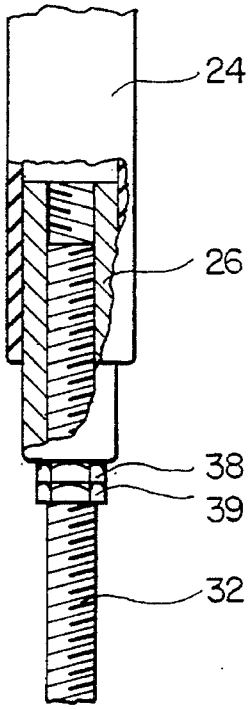
FIG. 3 is an enlarged scale view, partly in cut-away section, of a portion of the apparatus of FIG. 2.

Referring to FIGS. 1–6, a cap portion of putter structure 20 has been removed to provide a longitudinally-directed access opening at its handle end to a hollow-shafted portion. The hollow handle portion, after providing such access opening, is converted for receiving and stabilized positioning of adaptor structure for increasing the overall length. A distal end portion of the adaptor structure 22, better seen in FIGS. 2 and 3, is mounted within the open end (best seen in FIG. 6) of converted putter structure 20.

Coupling means in the form of a frusto-conical adaptor is shown at the lower end of the adaptor structure of FIG. 2. That adaptor end is inserted longitudinally into the hollow handle portion of putter structure 20. Means for adjustably extending the overall length of the combined adaptor and putter structures, in the form of a rod which is integral with such adaptor structure and extends upwardly toward a receptor means 24.

As taught herein, conversion putter structure 20 combined with adaptor structure 22 extends the overall length for putting purposes to provide for a pivot point anchoring of the combined structures to assist in achieving a pendulum-like movement for the putting stroke. The desired increased height combination is determined based largely on a particular golfer's height and putting stance.

The increased height concepts are carried out by using an adaptor structure 22, best seen in FIGS. 2 and 3, which contributes to the extension, and adjustability, by attachment and fixed positioning of its lower portion within the hollow handle portion of conversion putter structure 20.

The length-extending function is largely carried out by an elongated receptor 24 at the opposite longitudinal end of structure 22. The exterior of receptor 24 can have a substantially cylindrical, truncated-conical or combination configuration; its exterior covering can be the same as used for the grip portion of a club.

A specially threaded receptor bushing 26 is integral with receptor 24 at its lower distal end; that is, at the end of receptor 24 oriented toward putter structure 20 during usage. Bushing 26 presents upper end 28 and open lower end 30. Upper end 28 secures bushing 26 to receptor 24. Bushing 26 can be made integral with receptor 24 during fabrication or can be threaded on later. Bushing 26 is open internally throughout its length leading to an internal cavity for receptor 24 and through length-adjustor rod 32 to conversion putter structure 20.

Length-adjustor rod 32 is threaded into end 30 of bushing 26 and extends in both vertical directions therefrom; that is, into the internal cavity of receptor 24 and toward open-ended putter structure 20. Preferably, the internal cavity of receptor 24 provides support along the length of adjustor rod 32, in addition to that provided by bushing 26, in order to help provide desired longitudinal stability.

Figure 4:
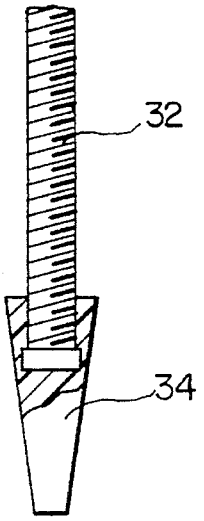
FIG. 4 is a partial view, in enlarged-scale cross-section, for describing one embodiment for coupling adaptor structure and putter structure of the invention.

In a specific embodiment, the earlier-described coupling means which can be readily-mounted within the putter structure 20 comprises a frusto-conical bushing 34 (as best seen in FIGS. 2, 4). That bushing is integral with the distal end of adjustor rod 32 which fits into conversion putter structure 20. Bushing 34 provides for frictionally-coupled mounting of adjustor rod 32 in the hollow interior of a tapered shaft of putter structure 20 (FIG. 4) at or near its handle end.

The configuration of frusto-conical bushing 34 is adapted to the hollow interior of the converted putter structure. Such bushing is selectively dimensioned diametrically to establish a height position along the axis of the putter shaft; and such height position can be selected. As described in relation to FIGS. 2 and 3, a major portion of the height extension is contributed by receptor 24; and final height adjustment is preferably carried out at receptor bushing 26.

Internally threaded bushing 26 and extension rod 32 are fabricated from materials selected for their physical and mechanical properties including durability and strength. The interfitting of bushing 26 and rod 32 help to provide stability at the upper end of adaptor structure 22. Preferably, those interfitting parts comprise metal selected from the group consisting of low-carbon steel (metallic-plated or otherwise protected, for example, with a polymeric coating against corrosion), stainless steel, or aluminum alloys.

In a specific embodiment, receptor 24 has a hollow interior with a selected length of about six to twelve inches; threaded rod 32 is approximately three-eighths inch to five-eighths inch in diameter, with an overall length selected between about ten to about twenty-five inches.

The lower distal end of receptor 24 can be externally tapered; and upper end 28 of bushing 26 can be made integral by threading into that end of receptor 24. The exterior of receptor 24 is preferably a non-metallic material. Receptor 24 includes a padded cap portion 35 (FIG. 2) as its upper distal end for contact with the sternum of the golfer during usage.

A conversion putter structure, for example, with a length of thirty-four inches, is maintained for optional use at that length; but is readily converted for use at an extended height; for example, at forty-six inches. In that specific example, receptor 24, along with bushing 26 at its lower distal end, can have an overall length, from lower end 30 to cap 35, of twelve inches. Adjustor rod 32 has an overall length of eighteen inches. Preferably, nine inches of rod 32 is lodged within the hollow receptor 24 and nine inches within the handle end of conversion putter structure 20. The result is an addition of twelve inches of overall height to enable sternum-anchored putting, with balanced longitudinal stability (of greater length than required) contiguous to each end of rod 32. In that example, should the hollow shaft of the putter structure be able to accommodate only eight inches of rod 32 (e.g. because of the configuration of frusto-conical bushing 32); then, ten inches of rod 32 can be inserted into receptor 24 in order to accomplish the desired overall height of forty-six inches.

To accommodate golfers between about five feet two inches and about six feet two inches in height, an average extension in a range between about six to about twelve inches can be used, dependent on the putting stance for each golfer. The desired overall length for sternum-assisted putting is measured from ground level to the golfer's sternum; that is, to the frontal center of the rib cage where the upwardly-directed ribs meet. As taught herein, padded end 35 against the sternum of the golfer establishes a pivot point for the desired pendulum-type movement of the club.

To cover such a range of golfer heights, the receptor 24, with bushing 26, is selected to have a height of about six to twelve inches and the rod 32 to have a length of about ten to twenty inches. The height of the sternum above ground level is determined with the golfer in the putting stance. In general, to accommodate the above range of golfers' heights, the overall length of the combined structures is selected, by way of example, to range from about forty inches to about forty-eight inches. The described structures of the invention, and dimensional ranges set forth, would adequately cover that range while providing for desired longitudinal stability. Other dimensions can be selectively accommodated, through use of the present teachings, by selection of differing dimension parts.

Figure 7:
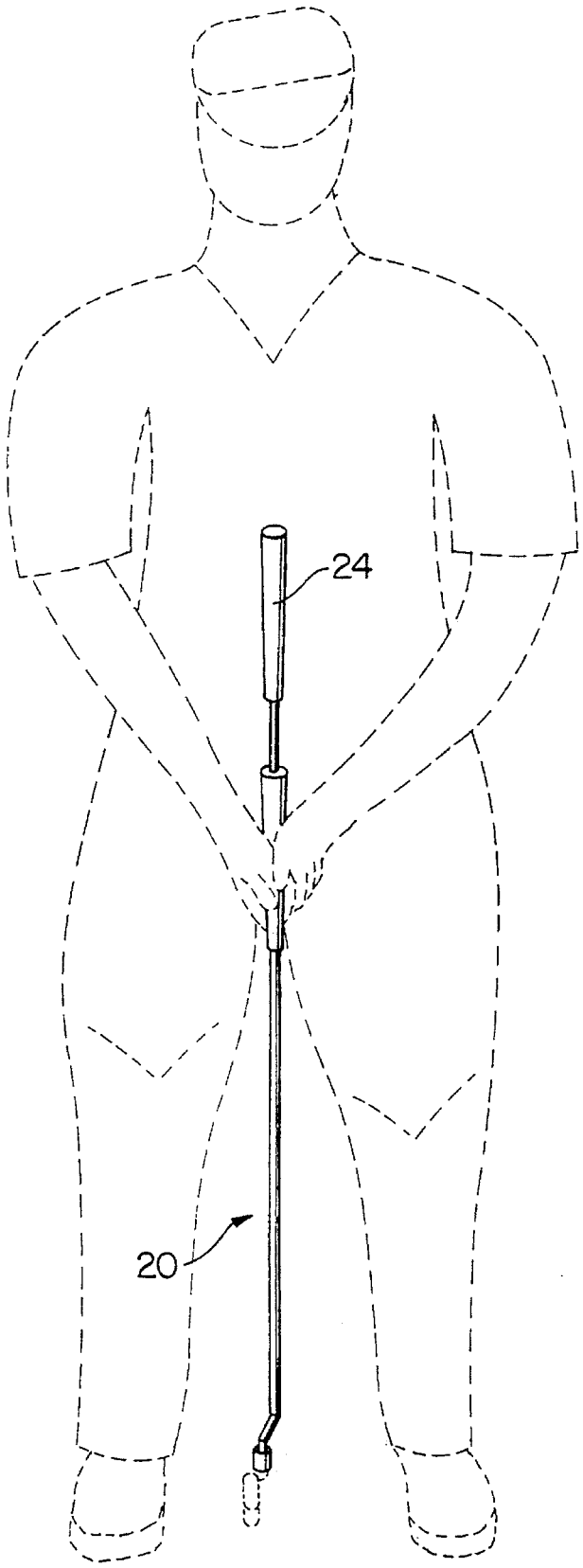
FIG. 7 is a perspective view for describing purposes and uses of the assembled golfing structure of FIG. 4.

The cap end 35 should be firmly in contact with the sternum of the golfer in putting stance, as shown in FIG. 7, and the bottom of the club head should extend to ground level with final height adjustment.

Frusto-conical bushing member 34 is inserted in hollow handle 37 through opening 40 (FIG. 6) of conversion putter structure 20. Bushing 34 is shaped for frictionally-positioning and stabilizing the location of the lower distal end of adaptor structure 22 in which the distal end of adjustor rod 32 is integral with the frusto-conical bushing 34, as best seen in FIG. 4. The configuration of frusto-conical bushing 34 matches that of the interior tapered hollow shaft of conversion putter structure 20. For longitudinally stabilizing such distal end of the rod 32, the height of bushing 34 extends over several inches; that is, sufficient to stabilize that distal end; or, other means to circumscribe rod 32 can be provided at locations between the frusto-conical coupling means 34 and open end 40 of the putter structure 20.

Preferably, adaptor bushing 34 is fabricated from thermosetting polymeric materials selected, for example, from selected solid epoxy resins, epoxy vinyl resins or reaction-molded polymers. The hardness of industrial plastics is not required; preferably, a static friction property of the polymeric material with the shaft metal, is selected to provide for adherence on the internal surface of the shaft to prevent relative rotation during usage while enabling such adaptor bushing 34 to be readily removed longitudinally during disassembly. The cross-sectional configuration of the bushing 34 should conform to the cross-sectional configuration of the putter at its desired location; and cross-sectional configuration should take into account longitudinal and lateral dimensions.

The location of the lower distal end of rod 32 within a conversion putter shaft is taken into account in overall height determination but, preferably, not in the final height adjustments. That is, the longitudinal position of frusto-conical bushing 34 is relatively fixed by its configuration. Adjustment of the effective length of rod 32, or taking up excess length, should therefore be accommodated by receptor 24.

In the manufacture of conversion putter structure from scratch, a threaded coupling arrangement could be used by internally threading a hollow metal shaft. Or an internally threaded metal or polymeric material sleeve can be inserted in the hollow shaft. Preferably, breechblock-type of segmented threads would be used for both coupling parts so that only a partial turn, after insertion of rod 32, interlocks a plurality of threads over an extended longitudinal length.

However, in many cases, conversion of a golfer's own putter is preferred; and, for that purpose, the frusto-conical adaptor 34 is preferred. That adaptor should have an extended height dimension so as to add to the longitudinal stability. For example, the lower distal end of rod 32 should be integral with a frusto-conical adaptor 34 (FIG. 4) and extend over at least about three to about six inches of height, depending upon the height being added.

The advantage of a single rod adjustor 32 coacting between receptor means 24 and putter structure 22 is that the centrally-located axis of the hollow shaft of the threaded rod adjustor, and of the receptor 24, can be readily made coincident. That arrangement helps the combination to act as if it were unitary. Such stability is increased if rod 32 can be supported over approximately the same percentage of its length at each of its ends. That is, if about four to eight inches of length is supported in the hollow tapered shaft, then at least about four to eight inches, or more, should be supported in receptor 24.

Referring to FIGS. 2 and 3, metallic bushing 26, affixed to hollow receptor 24, is internally threaded as indicated by FIG. 3. For purposes of maximizing the range of adaptation of adjustable-length rod 32, bushing 26 is preferably threaded throughout its length; and, the threading extends into the internal cavity of receptor 24. Bushing 26 and receptor 24 are used to cooperatively adjust and establish the new overall height. Rod 32 interfits within receptor 24 with their central longitudinal axes coincident; and, preferably, rod 32 is threaded, or otherwise supported through about four to ten inches of the internal cavity of receptor 24. The longitudinal stability provided is important during usage.

The location of bushing 34 (FIG. 4) within the conversion putter structure has been established. The length of adjustor rod 32 fitting within the handle end 40 (FIG. 6) of putter structure 20 is selected to provide desired stability along its length regardless of whether a frusto-conical bushing or other type of coupling means is used. That is, as assembled, the integral adaptor structure and/or other support structure should give the impression that structures are unitary.

The advantage of an extended-length frusto-conical coupler 34 is that it can be quickly inserted and stabilized within the hollow shaft of the putter structure without relative rotational movement between the rod and the putter structure; ease and quickness of assembly are important for use on the course especially in approaching or around a putting green. The height to be added has been determined and fixed so that insertion of frusto-conical bushing to its predetermined depth is all that is required.

The height to the sternum of the golfer in putting stance is a controlling factor. In a specific example, there is an assumed fixed receptor height (including bushing 26) of eight inches, a frusto-conical bushing 34 extending to provide its own stability of about four inches, an adjustor rod 32 length of sixteen inches, a putter structure height of thirty-four inches, and a desired extended overall height for the particular golfer which is forty-two inches; then with eight inches of the adjustor rod 32 within putter structure 20 and eight inches of the remaining length of a sixteen inch rod 32 threaded into the receptor 24, the rod 32 is then locked in place by hex nuts 38, 39 (FIG. 3); the desired increased height (eight inches) is added by receptor 24.

Figure 6:
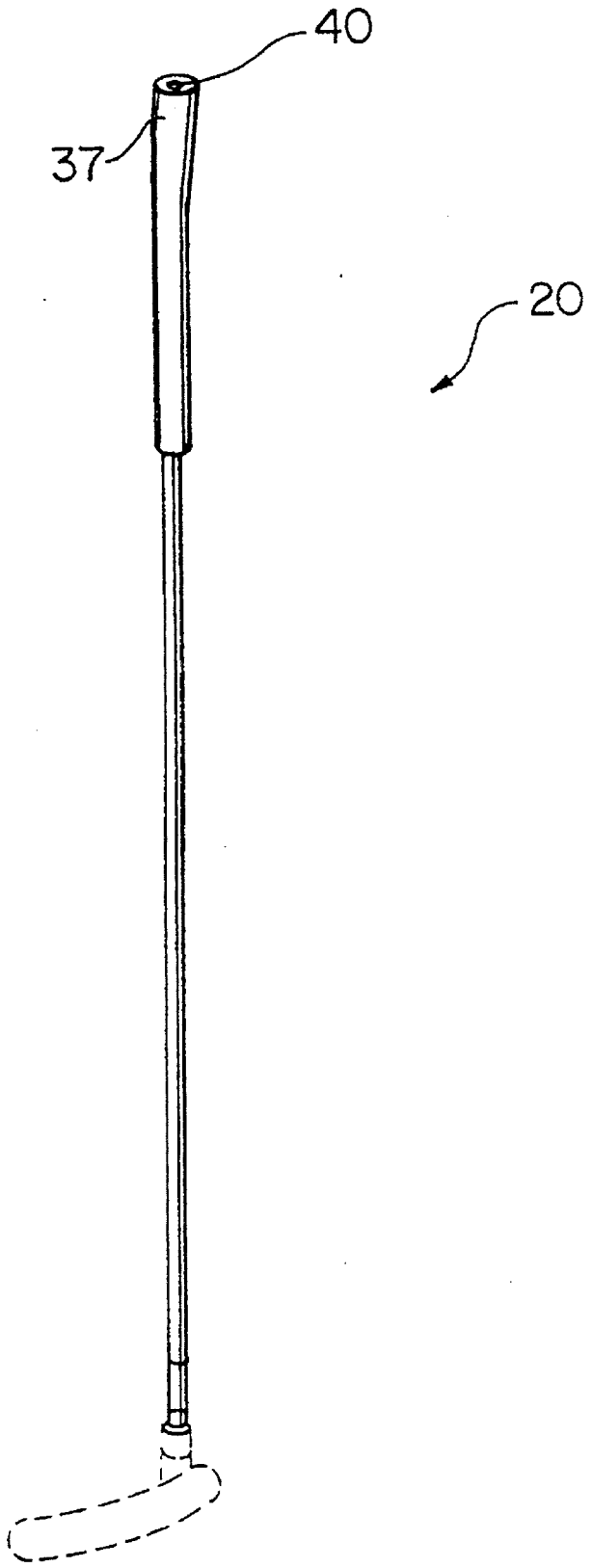
FIG. 6 is an enlarged-scale perspective view for describing one embodiment of receiving means at the handle end of the putter structure shown in FIG. 1.

Opening 40, providing access in the longitudinal direction, as shown in FIG. 6, is established in conversion putter structure 20 starting with removal of a putter cap. During use of the conversion putter structure, in combination with above-described adaptor structure, any remaining open portion at end 40, that is circumscribing rod 32, can be closed with half ring plastic inserts; or, a plastic insert with fluted pie-shaped flexible portions extending toward the opening for rod 32. Such cover means for a portion of opening 40 should, however, not interfere with free passage of frusto-conical bushing 34 into the conversion putter structure for quick assembly. Such cover means prevents undue moisture or debris from accumulating within an interior portion of the putter structure should the combination of adaptor structure and conversion putter structure remain assembled for extended periods. With the quick assembly provided, there is no need for carrying an extended length club.

The described adaptor structure is devised for quickly adding height for sternum-located pivoting of the extended-length converted combination structure to provide a pendulum-like motion, substantially free of so-called body motion faults, as earlier described. It is an advantage of the specific embodiment described that the golfer can carry or use a conversion putter structure of normal club height and then, rapidly, without attracting undue attention, switch to the new preselected extended height for sternum-pivot putting as desired. In practice, the added length provides added force for long putts and, with a shorter travel path for the putter-head due to the extended-length combination, makes the extended putter adaptable to any length putt.

While specific methods, apparatus, materials, dimensional data, conversion and manufacturing steps have been set forth for purposes of specifically describing embodiments of the invention, there are modifications which can be resorted to, in the light of the above teachings, while continuing to rely on novel concepts disclosed; therefore, in determining the scope of the present invention, reference shall be made to the appended claims.

What is claimed is:

1. Length-conversion method for golf-putting apparatus, comprising the steps of (A) providing putting structure having a putter head at one longitudinal end of an elongated tapered shaft, (B) providing an opening which is longitudinally directed into a hollow handle portion at a remaining distal end of such shaft, with said putting structure having a preselected length, (C) providing adaptor structure including (i) elongated receptor means having a hollow internal cavity, an external configuration selected from the group consisting of cylindrical, truncated-conical, and combinations thereof, (ii) receptor bushing means disposed at a distal end of the receptor means which is oriented toward the putting structure during usage in putting;

(iii) coupler means for fitting within the hollow handle portion of the putting structure, and (iv) an elongated length adjustor rod;

(D) preselecting the length dimension of said combined receptor means and receptor bushing means;

(E) orienting said length adjustor rod in the same longitudinal direction as said elongated shaft and the internal cavity of the elongated receptor means;

(F) joining the putting structure, the length adjustor rod, and receptor means so that centrally-located axes of said shaft, rod, and internal cavity are substantially coincident by utilizing said coupler means in the hollow portion of the putting structure and the bushing means at the lower distal end of the receptor means; and (G) establishing the overall length of the combined putting and adjustor structures by positioning an opposite longitudinal end part of the length adjustor rod in said hollow portion of the putter structure and said internal cavity of said receptor, respectively.

2. The method of claim 1, in which step (G) is carried out by:

combining the height of the receptor means, with its mounted bushing, with a selected length of the adjustor rod for any extended length required in excess of that of the receptor and bushing means.

3. The method of claim 1, in which step (F) is carried out by:

rigid intercoupling, substantially free of longitudinal play, which includes longitudinal extended supporting of said length adjustor rod within the receptor means and within the hollow handle portion of the conversion putter structure.

4. The method of claim 3, in which a frusto-conical bushing means, which is integral with said lower end of said adjustor rod means, is mounted within a tapered shaft of the putter structure to frictionally couple said frusto-conical bushing means with said shaft free of any requirement for relative rotational movement therebetween.

5. The method of claim 3, further including the steps of (H) closing off any remaining area of said opening, at the handle end of the putting structure, which circumscribes such rod.

6. The method of claim 1, including providing said receptor bushing means with internal threading, and in which said receptor bushing material and said adjustor rod material are selected from the group consisting of plated steel, stainless steel and aluminum alloys.

7. The method of claim 1, further including (I) providing said receptor means with a padded cap portion at an upper distal end for contact with the sternum of the golfer for whom the height is being preselectively extended.

8. Combination for adjustable conversion of the overall length of golf putting apparatus for optional dual-height usages, comprising:

(A) golf putting structure having an elongated shaft extending between a club head end and a longitudinally directed opening into a hollow handle portion at a remaining longitudinally opposite end, said putting structure having a predetermined height permitting a first height usage;

(B) elongated length adjustor rod means;

(C) coupling means within said hollow handle portion of the putting structure for securing one distal end of the elongated length adjustor rod means, and (D) elongated receptor means having a hollow interior for receiving the remaining longitudinal distal end of the elongated length adjustor rod means;

said elongated shaft, rod means and receptor means being joined such that their axes are coincident, providing for coaction of said receptor means hollow handle portion and a selected length of said rod means, thus determining the overall length of the combined structures for a second height putting usage in which the upper distal end of the receptor means is pivotally held at the sternum of the golfer while in putting stance;

(E) receptor bushing means integral with said receptor means, and in which the material of said receptor bushing means and said rod means comprises metal selected from the group consisting of corrosion-protected mild steel, stainless steel, and aluminum alloys.

9. Combination for adjustable conversion of the overall length of golf putting apparatus for optional dual-height usages, comprising:

(A) golf putting structure having an elongated shaft extending between a club head end and a longitudinally directed opening into a hollow handle portion at a remaining longitudinally opposite end, said putting structure having a predetermined height permitting a first height usage;

(B) elongated length adjustor rod means;

(C) coupling means within said hollow handle portion of the putting structure for securing one distal end of the elongated length adjustor rod means, and (D) elongated receptor means having a hollow interior for receiving the remaining longitudinal distal end of the elongated length adjustor rod means;

said elongated shaft, rod means and receptor means being joined such that their axes are coincident, providing for coaction of said receptor means hollow handle portion and a selected length of said rod means, thus determining the overall length of the combined structures for a second height putting usage in which the upper distal end of the receptor means is pivotally held at the sternum of the golfer while in putting stance; in which said elongated height adjustor rod means is threaded externally substantially throughout its length, and the interior surface of said receptor means is correspondingly threaded.

10. Adaptor structure for coaction with converted putting structure to provide an extended overall length for selective height addition, comprising:

elongated receptor means of preselected longitudinal length presenting an elongated substantially hollow internal cavity, said receptor means having upper and lower longitudinal ends as oriented for usage;

receptor bushing means disposed at, and integral with, the lower distal end of said receptor means, said receptor bushing means having a hollow interior aligned longitudinally with said hollow internal cavity by the receptor means;

putter structure having an elongated shaft with a club head at one distal end and a hollow handle portion at a longitudinal opposite end, with a longitudinally directed opening at the distal end of said hollow handle portion;

an elongated length adjustor rod means having a predetermined length with one distal end for insertion into said receptor means by said receptor bushing means, and a remaining longitudinally opposite distal end for insertion within the hollow handle portion of said putter structure, and coupling means within said hollow handle end of the putter structure for fixing the position of said distal end of the rod means as inserted into said hollow handle portion, with the remaining distal end of the rod means being inserted into said receptor means, with the length of said rod means inserted into said receptor means being controlled by said receptor bushing means, and in which the length of said putter structure is increased by an amount equal at least to the length of said receptor means.

11. The adaptor structure of claim 10, in which said coupling means within the putter shaft is integral with the distal end of said adjustor rod means, said coupling means having a configuration providing for static friction mounting of said adjustor rod means at a preselected location within said hollow handle portion of the putter structure.

12. The adaptor structure of claim 11, in which said coupling means present a frusto-conical configuration bushing selectively dimensioned diametrically to establish a height position along the length of said putter structure and with a longitudinally directed dimension to provide for longitudinal stability of said distal end in said hollow handle portion.

13. The adaptor structure of claim 12, in which the material of said receptor bushing means and said rod means comprises metal selected from the group consisting of mild steel which is plated or otherwise protected against corrosion, stainless steel and aluminum alloys.

14. The adaptor structure of claim 11, in which said coupling means within the hollow handle portion comprises a polymeric material selected from the group consisting of solid epoxy resins, epoxy vinyl resins and reaction-molded polymers.

15. The adaptor structure of claim 13, in which said receptor bushing means is internally threaded along its hollow interior, and said adjustor rod means present corresponding external threading for interfitting within said hollow interior of said bushing means for controlling the length of the rod means disposed within said receptor means.

16. Adaptor structure according to claim 12, in which said coupling means with the hollow handle portion of said putter structure present a cross-sectional configuration selected for conformity with longitudinal and lateral dimensions of said hollow handle portion of said putter structure, and in which said coupling means extend over sufficient lengths within said hollow handle portion to longitudinally stabilize coupling of said structures.

* * * * *